US012305322B2

(12) United States Patent
Kim et al.

(10) Patent No.: US 12,305,322 B2
(45) Date of Patent: May 20, 2025

(54) CLOTHES TREATMENT APPARATUS AND METHOD FOR CONTROLLING CLOTHES TREATMENT APPARATUS

(71) Applicant: LG Electronics Inc., Seoul (KR)

(72) Inventors: Jaehyung Kim, Seoul (KR); Seungphyo Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/766,191

(22) Filed: Jul. 8, 2024

(65) Prior Publication Data

US 2024/0360616 A1 Oct. 31, 2024

Related U.S. Application Data

(62) Division of application No. 17/274,045, filed as application No. PCT/KR2019/011445 on Sep. 5, 2019, now Pat. No. 12,037,738.

(30) Foreign Application Priority Data

Sep. 6, 2018 (KR) ..... 10-2018-0106480

(51) Int. Cl.
*D06F 58/44* (2020.01)
*D06F 34/26* (2020.01)
(Continued)

(52) U.S. Cl.
CPC ..... *D06F 58/44* (2020.02); *D06F 34/26* (2020.02); *D06F 34/32* (2020.02); *D06F 58/10* (2013.01);
(Continued)

(58) Field of Classification Search
CPC ..... D06F 34/26; D06F 34/32; D06F 58/10; D06F 58/24; D06F 58/44; D06F 58/203;
(Continued)

(56) References Cited

U.S. PATENT DOCUMENTS

2009/0113944 A1 5/2009 Kim et al.
2009/0241269 A1 10/2009 Yoo et al.
(Continued)

FOREIGN PATENT DOCUMENTS

EP 3502338 6/2019
JP H04-285598 10/1992
(Continued)

OTHER PUBLICATIONS

KR Notice of Allowance in Korean Appln. No. 10-2020-0109923, dated Oct. 20, 2020, 6 pages (with English translation).
(Continued)

*Primary Examiner* — Joseph L. Perrin
(74) *Attorney, Agent, or Firm* — Fish & Richardson P.C.

(57) ABSTRACT

A clothes treatment apparatus includes: a first chamber in which clothes are accommodated; a support part which is provided in the first chamber and in which the clothes are held; a driving unit for making the support part reciprocate along the width direction of the first chamber; a circulation duct for drawing air out from inside the first chamber and then resupplying the air into the first chamber; a heat exchange part for sequentially dehumidifying and heating the air that has flowed into the circulation duct; a fan provided inside the circulation duct; a moisture supply unit for supplying moisture into the first chamber; a sensing unit for measuring at least one among the concentration of dust and the concentration of odor particles contained in the air in the first chamber; and a display unit on which information is displayed.

8 Claims, 5 Drawing Sheets

(51) Int. Cl.

| | |
|---|---|
| ***D06F 34/32*** | (2020.01) |
| ***D06F 58/10*** | (2006.01) |
| ***D06F 58/20*** | (2006.01) |
| ***D06F 58/24*** | (2006.01) |
| ***D06F 73/02*** | (2006.01) |
| *D06F 103/28* | (2020.01) |
| *D06F 105/52* | (2020.01) |
| *D06F 105/58* | (2020.01) |

(52) U.S. Cl.
CPC ..... *D06F 58/203* (2013.01); *D06F 58/24* (2013.01); *D06F 73/02* (2013.01); *D06F 58/206* (2013.01); *D06F 2103/28* (2020.02); *D06F 2105/52* (2020.02); *D06F 2105/58* (2020.02)

(58) Field of Classification Search
CPC .... D06F 58/206; D06F 73/02; D06F 2103/28; D06F 2105/52; D06F 2105/58
See application file for complete search history.

(56) References Cited

U.S. PATENT DOCUMENTS

| | | | |
|---|---|---|---|
| 2010/0139366 | A1 | 6/2010 | Krausch |
| 2010/0236296 | A1 | 9/2010 | Choi et al. |
| 2012/0160269 | A1 | 6/2012 | Pyo et al. |
| 2012/0317729 | A1 | 12/2012 | Song et al. |
| 2017/0327306 | A1 | 11/2017 | Nam et al. |
| 2018/0334767 | A1 | 11/2018 | Kim et al. |
| 2020/0080252 | A1 | 3/2020 | Lee et al. |

FOREIGN PATENT DOCUMENTS

| | | |
|---|---|---|
| JP | 2002-011276 | 1/2002 |
| JP | 2007-101100 | 4/2007 |
| JP | 2010-022556 | 2/2010 |
| JP | 2014-240598 | 12/2014 |
| KR | 10-2005-0010415 | 1/2005 |
| KR | 10-2009-0107848 | 10/2009 |
| KR | 10-2011-0067887 | 6/2011 |
| KR | 10-2012-0074557 | 7/2012 |
| KR | 10-2017-0128958 | 11/2017 |
| KR | 10-2017-0137503 | 12/2017 |
| KR | 10-2018-0051817 | 5/2018 |
| KR | 10-2018-0086168 | 7/2018 |
| WO | WO2009/060056 | 5/2009 |
| WO | WO 2017/184769 | 10/2017 |
| WO | WO 2018/212585 | 11/2018 |

OTHER PUBLICATIONS

PCT International Search Report and Written Opinion in International Appln. No. PCT/KR2019/011445, dated Jan. 15, 2020, 7 pages (English translation only).
KR Notice of Allowance in Korean Appln. No. 10-2021-0007230, dated Jun. 23, 2021, 2 pages (with English translation).
Extended European Search Report in European Appln No. 19856950.1, dated May 6, 2022, 8 pages.
Office Action in Japanese Appln. No. 2021-512724, dated Apr. 19, 2022, 12 pages (with English translation).
Office Action in Chinese Appln. No. 201980058137.3, dated Aug. 31, 2022, 27 pages (with English translation).

CLOTHES TREATMENT APPARATUS AND METHOD FOR CONTROLLING CLOTHES TREATMENT APPARATUS

CROSS-REFERENCE TO RELATED APPLICATIONS

This application is a divisional of U.S. application Ser. No. 17/274,045, filed on Mar. 5, 2021, which is a National Stage application under 35 U.S.C. § 371 of International Application No. PCT/KR2019/011445, filed on Sep. 5, 2019, which claims the benefit of Korean Application No. 10-2018-0106480, filed on Sep. 6, 2018. The disclosures of the prior applications are incorporated by reference in their entirety.

TECHNICAL FIELD

The present disclosure relates to a laundry treating apparatus and a control method for the same.

BACKGROUND

Generally, a laundry treating apparatus refers to an apparatus that carries out a series of processes (e.g., washing, drying, deodorization, wrinkle removal, etc.) in relation to laundry. The term "laundry treating apparatus" may comprise a washing machine for washing laundry, a drying machine for drying wet laundry, and an apparatus for removing odors or wrinkles out of laundry.

Since laundry treating apparatuses of the related art carry out treating processes by rubbing laundry with a drum, in which laundry is accommodated, through a driving unit rotating the drum and a supply unit supplying the air to the drum, they are favorable for drying of laundry but are limited in preventing wrinkles from occurring in laundry or removing wrinkles from laundry.

The laundry treating apparatuses of the related art have a problem in that there is no function of sensing or indicating a state of laundry such as an odor level of laundry and a dust level of laundry when laundry treating processes such as wrinkle removal, deodorization and drying of laundry are performed. Therefore, a problem occurs in that the laundry treating apparatuses of the related art fail to notify a user how a state of laundry (a contamination level, etc.) is improved through a laundry treating process.

Also, a problem occurs in that the laundry treating apparatuses of the related art fail to notify a user how a contamination level of laundry is changed while a laundry treating process is being performed.

Also, a problem occurs in that the laundry treating apparatuses of the related art fail to notify a user that a separate action, such as a case that washing is additionally required, is required after a laundry treating process is completed.

SUMMARY

An object of the present disclosure is to provide a laundry treating apparatus capable of carrying out drying, deodorization and wrinkle removal of laundry through a support for fixing a laundry in a state that the laundry is unfolded.

Another object of the present disclosure is to provide a laundry treating apparatus that senses a state of laundry (an odor level of laundry, a dust level of laundry, etc.) and notifies a user of the sensed state.

Still another object of the present disclosure is to provide a laundry treating apparatus that notifies a user how a contamination level of laundry is changed while a laundry treating process is being performed, in real time.

Further still another object of the present disclosure is to provide a laundry treating apparatus that allows a user to check how a contamination level of laundry is improved through a laundry treating process.

Further still another object of the present disclosure is to provide a laundry treating apparatus that notifies a user that a separate action, such as washing, is required after a laundry treating process is completed.

A control method for a laundry treating apparatus comprises a first chamber in which laundry is accommodated, a support module provided in the first chamber, hanging laundry therein, a driving module allowing the support module to reciprocate along a width direction of the first chamber, a circulating duct drawing out the air inside the first chamber and then re-supplying the air to the first chamber, a heat exchanger sequentially dehumidifying and heating the air entering the circulating duct, a fan provided inside the circulating duct, a water supply module supplying water to the first chamber, sensing module measuring at least one of a concentration of dust and a concentration of odor particles, which are contained in the air of the first chamber, and a display module on which information is displayed, the control method comprising: a sensing step of measuring a contamination level of the air of the first chamber through the sensing module; a displaying step of displaying the contamination level measured in the sensing step on the display module; and a treating step of operating at least one of the air supply module and the water supply module. The sensing step and the displaying step may be repeated per preset reference period while the treating step is being executed.

The displaying step may be provided to display at least one of symbols set differently depending on the contamination level measured in the sensing step, texts set differently depending on the contamination level measured in the sensing step, images set differently depending on the contamination level measured in the sensing step, same symbols set in different colors depending on the contamination level measured in the sensing step, same texts set in different colors depending on the contamination level measured in the sensing step, and same images set in different colors depending on the contamination level measured in the sensing step.

The treating step may include allowing the support module to reciprocate at a first period which is preset, if the concentration of dust inside the first chamber, which is measured in the sensing step, is a reference value or more, and the treating step may include allowing the support module to reciprocate at a second period set to be longer than the first period if the concentration of dust inside the first chamber, which is measured in the sensing step, is less than the reference value.

The treating step may include operating the water supply module for a first supply time which is preset, if the concentration of odor particles, which is measured in the sensing step, is a reference value or more, and the treating step may include operating the water supply module for a second supply time set to be shorter than the first supply time if the concentration of odor particles, which is measured in the sensing step, is less than the reference value.

The sensing step may include a shaking step of reciprocating the support module inside the first chamber by operating the driving module; a circulating step of operating the fan; and a first measuring step of measuring at least one of the concentration of dust and the concentration of odor particles, which are contained in the air entering the circulating duct.

The control method of the present disclosure may further comprise an execution time determining step of determining an execution time of the treating step; a second measuring step of measuring a contamination level of the first chamber through the sensing module when a reference time set to be shorter than the execution time and longer than the reference period passes from the time when the treating step is initiated; and an extension step of extending the execution time when the contamination level measured in the second measuring step is greater than a preset target value.

The extension step may be executed only if extension times of the execution time are less than preset reference times.

The control method of the present disclosure may further comprise a step of ending the treating step and a step of displaying a message recommending water washing on the display module if the extension times of the execution time are greater than the preset reference times.

The present disclosure provides a laundry treating apparatus comprising: a cabinet; a first chamber provided inside the cabinet, providing a space in which laundry is accommodated; a second chamber provided in the cabinet, forming a space spaced apart from the first chamber; a support module provided in the first chamber, hanging laundry therein; a driving module allowing the support module to reciprocate along a width direction of the first chamber; a circulating duct provided in the second chamber, drawing out the air inside the first chamber to the second chamber and then re-supplying the air to the first chamber; a first heat exchanger dehumidifying the air entering the circulating duct; a second heat exchanger heating the air passing through the first heat exchanger; a fan provided inside the circulating duct; a water supply module provided inside the second chamber, supplying water to the first chamber; a sensing module measuring a contamination level by measuring at least one of a concentration of dust and a concentration of odor particles, which are contained in the air of the first chamber; and a display module on which the contamination level measured by the sensing module is displayed, wherein the sensing module measures the contamination level per preset reference period, and the display module displays a contamination level per reference period.

The displaying module may be provided to display at least one of symbols set differently depending on the contamination level measured by the sensing module, texts set differently depending on the contamination level measured by the sensing module, images set differently depending on the contamination level measured by the sensing module, same symbols set in different colors depending on the contamination level measured by the sensing module, same texts set in different colors depending on the contamination level measured by the sensing module, and same images set in different colors depending on the contamination level measured by the sensing module.

The present disclosure provides a laundry treating apparatus capable of carrying out drying, deodorization and wrinkle removal of laundry through a support module for fixing a laundry in a state that the laundry is unfolded.

Also, the present disclosure provides a laundry treating apparatus that senses a state of laundry (an odor level of laundry, a dust level of laundry, etc.), and notifies a user of the sensed state.

Also, the present disclosure provides a laundry treating apparatus that notifies a user how a contamination level of laundry is changed while a laundry treating process is being performed, in real time.

Also, the present disclosure provides a laundry treating apparatus that allows a user to check how a contamination level of laundry is improved through a laundry treating process.

Also, the present disclosure provides a laundry treating apparatus that notifies a user that a separate action, such as washing, is required after a laundry treating process is completed.

DETAILED DESCRIPTION

Hereinafter, the preferred embodiments according to the present disclosure will be described with reference to the accompanying drawings. A configuration of an apparatus or a control method thereof, which will be described below, is intended to describe the embodiment of the present disclosure but is not intended to limit the scope of the present disclosure. Wherever possible, the same reference numbers will be used throughout the drawings to refer to the same or like parts.

Figure 1:
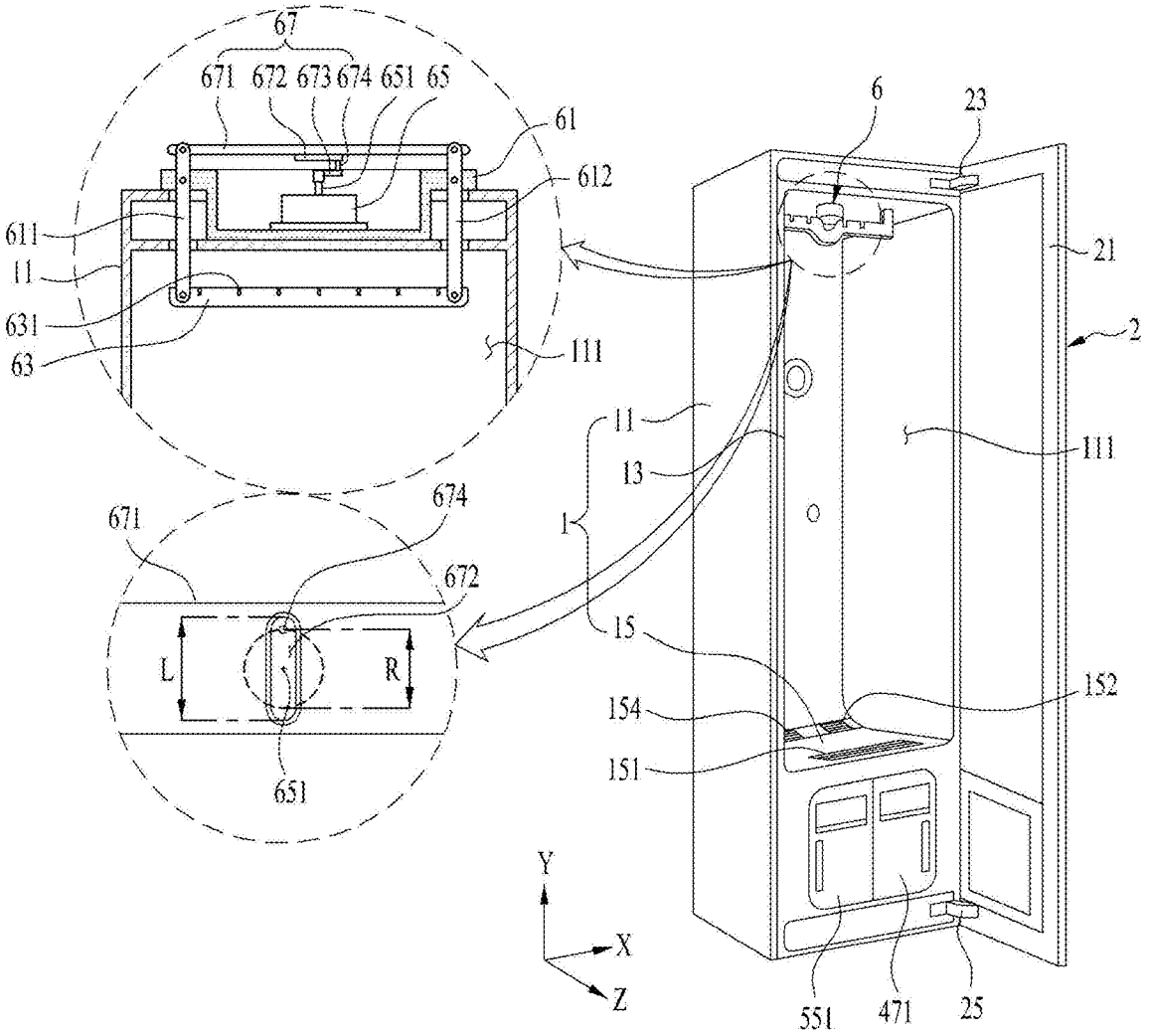
FIGS. 1 and 2 illustrate an example of a laundry treating apparatus of the present disclosure.
Figure 2:
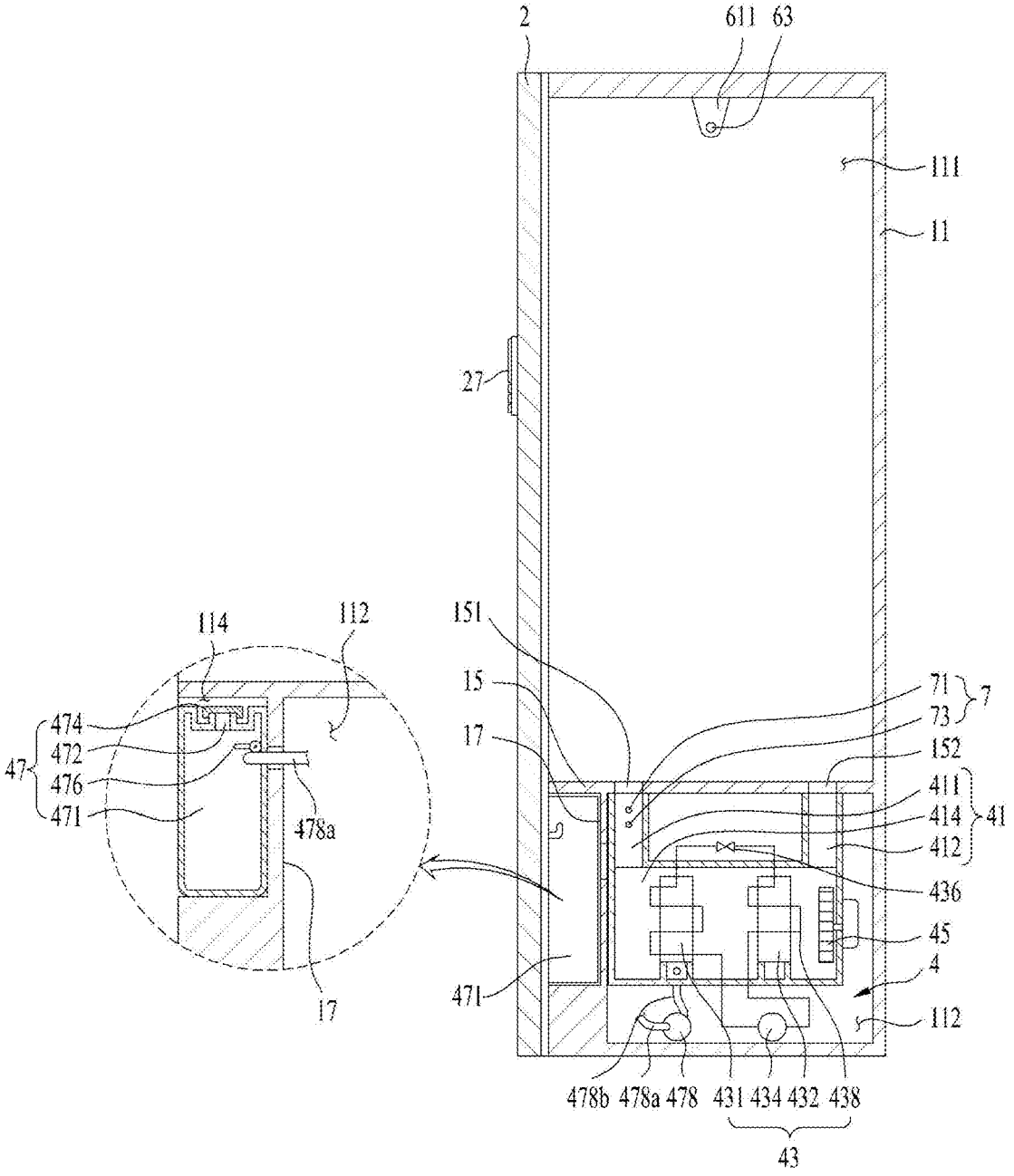
Figure 3:
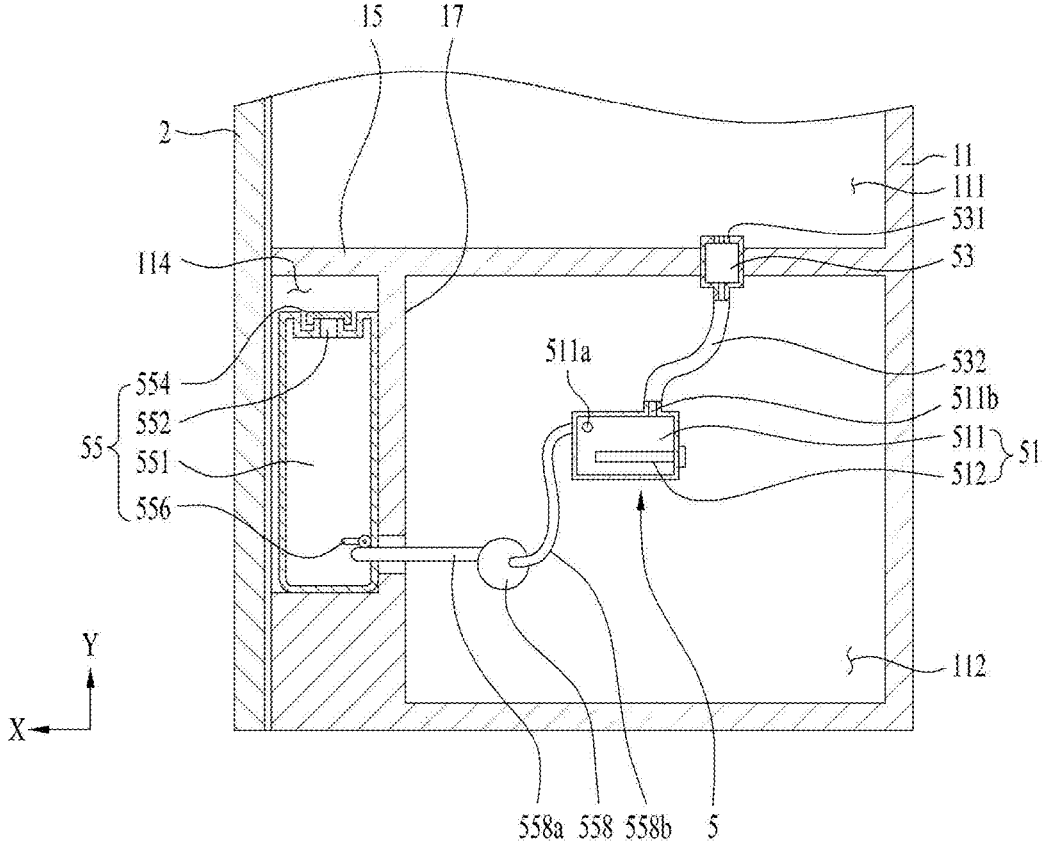
FIG. 3 illustrates an example of a water supply module provided in the present disclosure.

As shown in FIG. 1, a laundry treating apparatus 100 of the present disclosure comprises a cabinet 1 forming an external appearance, and a first chamber 111 provided inside the cabinet, providing a space in which laundry is accommodated. As shown in FIG. 2, a second chamber 112 forming a space spaced apart from the first chamber, positioned below the first chamber is provided inside the cabinet. Supply modules 4 and 5 for supplying at least one of water and the air to the first chamber 111 is provided inside the second chamber 112. FIGS. 2 and 3 illustrate that the supply modules 4 and 5 are provided as an air supply module 4 for supplying the air to the first chamber 111 and a water supply module 5 for supplying water to the first chamber, as an example.

As shown in FIG. 1, the cabinet 1 may be provided to include a cabinet body 11 provided with an inlet 13 on a front surface. In this case, the first chamber 111 is fixed to the cabinet body 11 and communicated with the inlet 13, and the first chamber 111 and the second chamber 112 may be partitioned from each other by a first partition 15 for partitioning an inner space of the cabinet body 11 into an upper space and a lower space.

As shown in FIG. 2, the cabinet body 11 may be provided with a tank seating portion 114 positioned below the first chamber 111 and in front of the second chamber 112. The tank seating portion 114 may be partitioned from the first chamber 111 by the first partition 15, and may be provided to form a space partitioned from the second chamber 112 through a second partition 17.

As shown in FIG. 1, the inlet 13 and the tank seating portion 114 may be provided to be opened or closed by a door 2. That is, the door 2 may include a door body 21 provided in a shape capable of closing both the inlet 13 and the tank seating portion 114, and first and second hinges 23 and 25 for rotatably fixing the door body 21 to the cabinet body 11.

Figure 4:
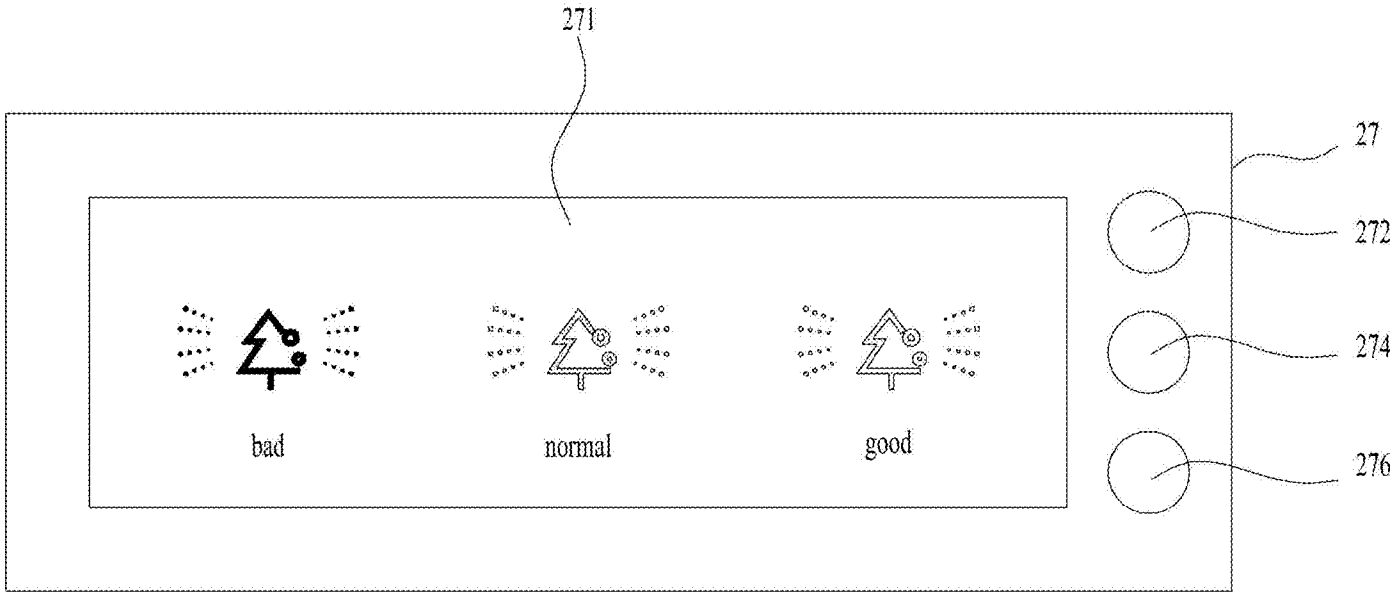
FIG. 4 illustrates an example of a control panel provided in a laundry treating apparatus of the present disclosure.

The door body 21 is provided with a control panel 27. As shown in FIG. 4, the control panel 37 may be provided with a display module 271 on which a control command is displayed, and input modules 272, 274 and 276 to which the control command is input from a user. The input modules may be provided to include a first input module 272 to which a control command to supply a power to a controller and the supply modules 4 and 5 is input, a second input module 274 to which a selection command of a course (laundry treating stroke) provided in the laundry treating apparatus, and a third input module 276 to which a start command or a stop command of the selected course is input.

As shown in FIG. 2, the first partition 15 is provided with a first communication hole 151 and a second communication hole 152, which communicate the first chamber 111 with the second chamber 112.

The air supply module 4 may be provided to include a circulating duct 41 provided in the second chamber 112, a heat exchanger 43 for sequentially executing dehumidification and heating of the air entering the circulating duct, and a water collecting module 47 for discharging condensed water generated from the heat exchanger 43 to the outside of the second chamber 112.

The circulating duct may be provided to include an intake duct 411 connected to the first communication hole 151, an exhaust duct 412 connected to the second communication hole 152, and a connection duct 414 connecting the intake duct with the exhaust duct.

The circulating duct is provided with a fan 45 for allowing the air of the first chamber 111 to move to the intake duct, the connection duct and the exhaust duct in due order, and FIG. 2 illustrates that the fan 45 is provided in the connection duct 414 as an example.

The heat exchanger 43 may be provided in any device as far as it may dehumidify the air entering the intake duct 411 and heat the dehumidified air, and FIG. 2 illustrates that the heat exchanger 43 is provided as a heat pump as an example.

That is, the heat exchanger 43 of FIG. 2 may be provided to include a refrigerant pipe 438 forming a circulating path of a refrigerant, a first heat exchanger 431 fixed to the refrigerant pipe and positioned inside the connection duct 414, a second heat exchanger 432 fixed to the refrigerant pipe and positioned between the first heat exchanger 431 and the fan 45, a compressor 434 circulating the refrigerant between the two heat exchangers 431 and 432 along the refrigerant pipe, and a pressure controller 436 for controlling a pressure of the refrigerant pipe. The compressor 434 and the pressure controller 436 may be positioned outside the circulating duct 41.

The first heat exchanger 431 may be provided as an evaporator for cooling the air by transferring heat of the air entering the intake duct 411 to the refrigerant, and evaporating the refrigerant. In this case, water contained in the air will be collected in a bottom surface of the connection duct 414 by moving along a surface of the first heat exchanger 431.

The second heat exchanger 432 may be provided as a condenser for heating the air and condensing the refrigerant by transferring heat of the refrigerant passing through the compressor 434 to the air passing through the first heat exchanger.

The first communication hole 151 may be provided with a filter (not shown) to filter particles contained in the air entering the intake duct 411.

The water collecting module 47 may be provided to include a water collecting tank 471 provided in the tank seating portion 114, providing a space in which water is stored, a water collecting tank through hole provided to pass through the water collecting tank 471, a first discharge pipe 478*a* inserted into the water collecting tank through hole, a second discharge pipe 478*b* discharging the condensed water discharged from the first heat exchanger 431 to the outside of the circulating duct, and a discharge pump 478 moving the condensed water discharged to the second discharge pipe 478*b* to the first discharge pipe 478*a*.

The water collecting tank 471 may detachably be provided in the tank seating portion 114. In this case, a check valve 476 may be provided in the water collecting tank through hole. The check valve 476 is provided to allow the first discharge pipe 478*a* to be inserted into the water collecting tank through hole and prevent the water inside the water collecting tank from being discharged through the water collecting tank through hole. Therefore, if the water collecting tank 471 is fixed to the tank seating portion 114, the controller may move the condensed water inside the circulating duct to the water collecting tank 471 through the discharge pump 478.

A drainage hole 472 for discharging the condensed water stored in the water collecting tank 471 is provided on one surface of the water collecting tank 471, and FIG. 2 illustrates that the drainage hole 472 is provided on an upper surface of the water collecting tank as an example. The drainage hole 472 may be opened or closed by a cover 474 detachably provided in the water collecting tank.

The water supply module 5 provided in the present disclosure may be provided to supply heated steam to the first chamber, or may be provided to supply steam (mist, etc.), which is not heated, to the first chamber. FIG. 3 illustrates that the water supply module 5 is provided to supply steam generated by heating water to the first chamber 111 as an example.

That is, the water supply module 5 may be provided with a steam generator 51 provided in the second chamber 112, generating steam, a spray module 53 discharging steam generated from the steam generator to the first chamber 111, and a water supply module 55 supplying water to the steam generator.

The steam generator 51 may include a storage module 511 provided inside the second chamber 112, providing a space in which water is stored, and a heater 512 provided to heat water inside the storage module 511. The storage module 511 is provided with a water supply hole 511*a* through which water enters, and a steam discharge hole 511*b* discharging steam inside the storage module 511.

The spray module 53 may be provided as a spray body fixed to a third communication hole 154 (see FIG. 1) provided to pass through the first partition 15. In this case, the spray body may be connected to the steam discharge hole 511*b* through a connection pipe 532, and the steam inside the spray body may move to the first chamber 111 through a spray hole 531 passing through an upper surface of the spray body.

The water supply module 55 may be provided to include a supply tank 551 provided in the tank seating portion 114, and a supply pump 558 supplying water stored in the supply tank 551 to the storage module 511.

The supply tank 551 may detachably be provided in the tank seating portion 114. In this case, the supply tank 551 is provided with a supply tank through hole provided to pass through the supply tank and a check valve 556 opening or closing the supply tank through hole, and the water supply module 55 may be provided to include a first supply pipe 558*a* inserted into the supply tank through hole by passing through the second partition 17, and a second supply pipe 558*b* connected to the water supply hole 511*a*. In this case, the water entering the first supply pipe 558*a* will be moved to the second supply pipe 558*b* through the supply pump 558.

The check valve 556 is provided to open the supply tank through hole only if the first supply pipe 558*a* is inserted into the supply tank through hole. Therefore, if the supply tank 551 is fixed to the tank seating portion 114, the controller will supply water to the storage module 511 through the supply pump 558.

A water supply hole 552 is provided on one surface of the supply tank 551, and FIG. 3 illustrates that the water supply hole 552 is provided on the upper surface of the supply tank as an example. The water supply hole 552 may be opened or closed by a cover 554 detachably provided in the supply tank.

The controller provided to control the air supply module 4 and the water supply module 5 may be provided in the second chamber 112.

As shown in FIG. 1, the laundry treating apparatus 100 of the present disclosure is provided with a support module 6 for fixing laundry into the first chamber 111 in a state that the laundry is unfolded. The support module 6 includes a frame 61 fixed to the cabinet body 11 and positioned above the first chamber, and first and second connection modules 611 and 612 rotatably fixed to the frame 61.

The first connection module 611 may be provided as a bar having one end positioned inside the first chamber 111 and the other end positioned outside the first chamber 111, and may be fixed to the frame 61 through a first shaft positioned between two free ends.

The second connection module 612 may also be provided as a bar having one end positioned inside the first chamber 111 and the other end positioned outside the first chamber 111. The second connection module 612 may be fixed to the frame 61 through a second shaft positioned between two free ends.

The support module 6 may include a support bar 63 fixed to the first and second connection modules 611 and 612 and positioned inside the first chamber 111. The support bar 63 may be provided as a bar parallel with a width direction (X-axis direction) of the first chamber. The support bar 63 may be provided with a hook accommodating groove 631 in which a hanger hook is detachably accommodated.

The support module 6 may reciprocate along the width direction (X-axis direction) of the first chamber through a driving module. The driving module may be provided to include a motor 65 fixed to the frame 61, and a power converter 67 converting a rotational motion of the motor to a straight reciprocating motion of the support bar 63.

The power converter 67 may be provided to include a converter body 671 connecting the free end of the first connection module 611 positioned outside the first chamber 111 with the free end of the second connection module 612 positioned outside the first chamber 111, a slot 672 provided in the converter body 671, a connection bar 673 rotated by a rotary shaft 651 of the motor, and a slot protrusion 674 provided in the connection bar 673 and inserted into the slot 672.

The slot 672 is provided to be orthogonal to a motion direction of the support bar 63. That is, if the support bar 63 is provided along the width direction (X-axis direction) of the first chamber, the slot 672 may be provided along a depth direction (Z-axis direction) of the first chamber.

When the rotary shaft 651 is rotated, the slot protrusion 674 forms a circular trace having a length of the connection bar 673 as a radius, wherein a diameter R of the circular trace is set to a length L or less of the slot 672. Therefore, a rotational motion of the slot protrusion 674 is converted to the straight reciprocating motion of the converter body 671. The support bar 63 is connected to the converter body 671 through the first connection module 611 and the second connection module 612. Therefore, the support bar 63 will be moved along the width direction of the first chamber 111 during motion of the converter body 671, and laundry hung in the support bar 63 will also be moved along the width direction of the first chamber 111.

The laundry treating apparatus 100 of the present disclosure further comprises a sensing module for sensing at least one of a concentration of dust contained in the air of the first chamber 111 and a concentration of odor particles. As an example, FIG. 2 illustrates that the sensing module 7 is provided to include an odor sensor 71 for measuring a concentration of odor particles contained in the air of the first chamber 111, and a dust sensor 73 for measuring a concentration of dust contained in the air of the first chamber 111.

The odor sensor 71 and the dust sensor 73 may be provided in any position of the laundry treating apparatus 100 as far as they are able to measure a contamination level of the air stored in the first chamber 111. As an example, FIG. 2 illustrates that the odor sensor 71 and the dust sensor 73 are provided in the intake duct 411.

The odor sensor 71 may be provided in any structure as far as it may sense gas particles contained in the air, and its example may include a sensor that includes an infrared light source, an infrared sensor, and a band-pass filter provided between the infrared light source and the infrared sensor. In the aforementioned sensor, since a signal sensed by the infrared sensor varies depending on types of gas particles, the controller may determine a concentration of the gas particles contained in the air through the signal of the infrared sensor.

The dust sensor 73 may also be provided in various structures as far as it may sense dust particles contained in the air, and its example may include a sensor that includes a light-emitting portion emitting light and a light-receiving portion absorbing light. If there is a lot of dust, since intensity of light received by the light-receiving portion will be reduced by scattering of light, the controller may determine the concentration of particles of dust contained in the air in accordance with intensity of light received by the light-receiving portion.

The laundry treating apparatus 100 of the present disclosure is characterized in that the contamination level of the air measured by the sensing module 7 is displayed on the display module 271. The display module 271 may be provided to display at least one of symbols set differently depending on the contamination level, texts set differently, images set differently, same symbols set in different colors, same texts set in different colors, and same images set in different colors. FIG. 4 illustrates that same images are displayed in different colors in accordance with a contamination level of the air and different texts are displayed in accordance with the contamination level, as an example. Therefore, in the present disclosure, the contamination level of the air in the first chamber may be notified to a user.

The sensing module 7 may be provided to sense the contamination level of the air inside the first chamber 111 every preset reference period, and the display module 271 may be provided to display the contamination level per reference period. Therefore, how the contamination level of laundry is changed while the laundry treating apparatus of the present disclosure is notified to a user in real time, whereby the user may check a laundry treating process.

Figure 5:
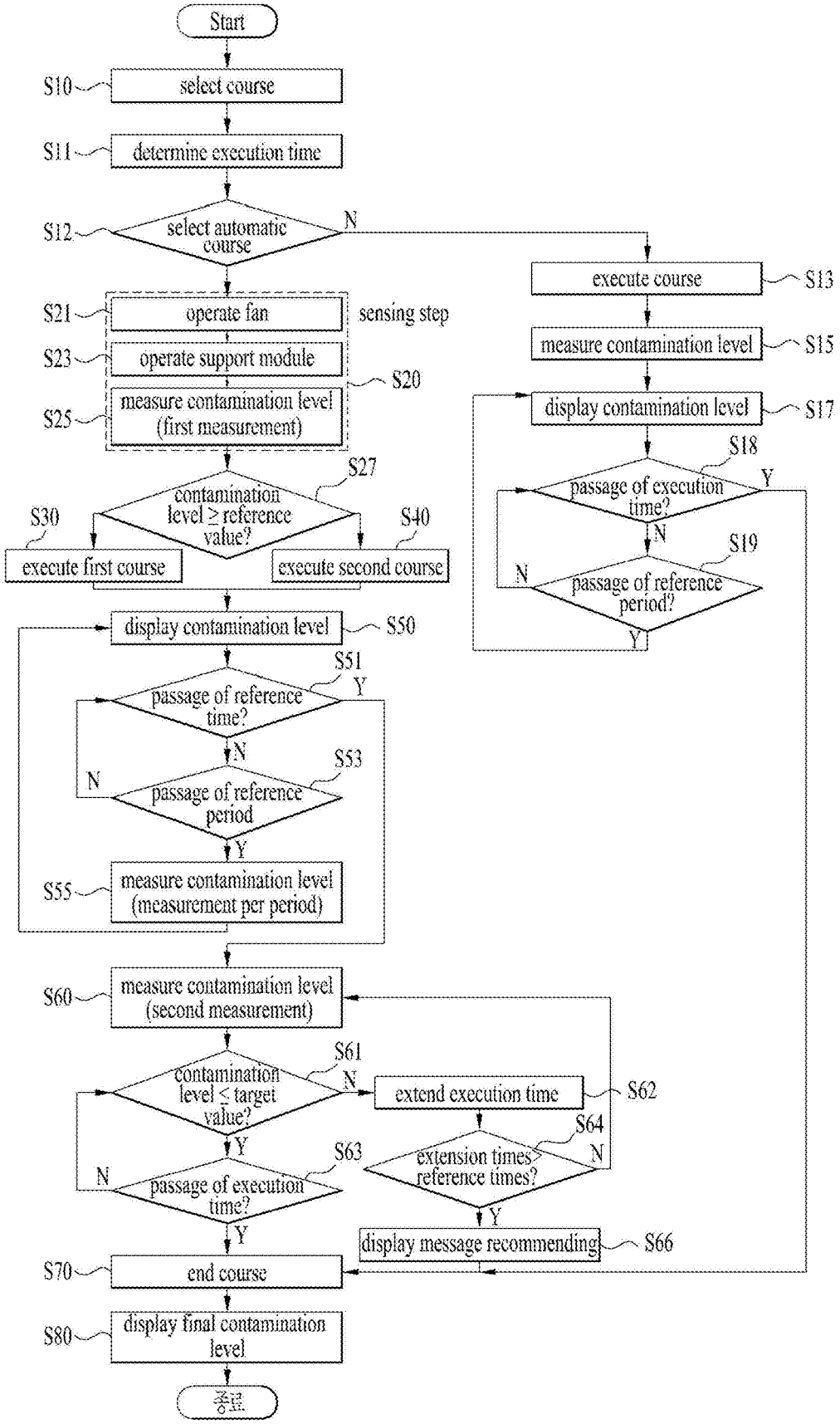
FIG. 5 illustrates an example of a control method for a laundry treating apparatus of the present disclosure.

Hereinafter, a control method for a laundry treating apparatus of the present disclosure will be described with reference to FIG. 5.

The control method for the laundry treating apparatus of the present disclosure is initiated through a course selection step S10 of allowing a user to select a desired course through an input module of the control panel 27. If the user selects a desired course through the course selection step S10, the control method for the present disclosure proceeds to an execution time determining step S11 of determining an execution time of the selected course and a step S12 of determining whether the course selected by the user is an automatic course. The execution time determining step S11 and the step S12 of determining whether the automatic course has been selected may be performed at the same time.

If the course selected by the user is an automatic course, the control method for the present disclosure proceeds to a sensing step S20 of allowing the sensing module 7 to measure a contamination level of the air in the first chamber 111.

The sensing step S20 may be provided to include a circulating step S21 of operating the fan 45, a shaking step S23 of reciprocating the support module 6 inside the first chamber 11 by operating the driving modules 65 and 67, and a measuring step S25 (first measuring step) of allowing the sensing module 7 to measure at least one of a concentration of dust contained in the air and a concentration of odor particles.

The circulating step S21 is a step of allowing the air stored in the first chamber 111 to enter the intake duct 411 and supplying the air entering the intake duct 411 to the first chamber 111 through the exhaust duct 412.

The shaking step S23 is a step of allowing the support bar 53 to reciprocate inside the first chamber 111 by rotating the motor 65. If the shaking step S23 proceeds, laundry hung in the support bar 63 will move inside the first chamber 111 together with the support bar 63. If the laundry moves inside the first chamber 111, since odor particles or dust remaining in the laundry will be detached from the laundry, in the present disclosure, the odor particles or dust remaining in the laundry may be detached from the laundry through the shaking step S23.

Preferably, the circulating step S21 and the shaking step S23 are executed at the same time. That is, the execution time of the circulating step S21 and the execution time of the shaking step S23 should be set such that their overlap time period may exist. However, a starting timing of the circulating step S21 and a start timing of the shaking step S23 do not need to be equal to each other. Therefore, the circulating step S21 may be executed to be earlier than the shaking step S23, or vice versa. However, if the shaking step S23 is executed to be earlier than the circulating step S21, the execution time of the first measuring step S25 may be shortened.

The first measuring step S25 is a step of measuring the contamination level of the air moving from the first chamber 111 to the intake duct 411 through the odor sensor 71 and the dust sensor 73. The first measuring step S25 may include any one of a step of measuring only a concentration of odor particles, a step of measuring only a concentration of dust, and a step of measuring both the concentration of odor particles and the concentration of dust.

If the first measuring step S25 is completed, the control method for the present disclosure proceeds to a step S27 of determining whether a contamination level of the measured air is a preset reference value or more, treating steps S30 and S40 of executing different courses depending on the contamination level of the measured air, and a displaying step S50 of displaying the contamination level of the measured air on the display module 271.

The step S27 of comparing the contamination level with the reference value may be executed as the controller compares the value transmitted from the sensing module 7 with the reference value.

The treating step is a step of operating at least one of the air supply module 4 and the water supply module 5. The treating step may be provided to include a first course execution step S30 executed when the measured contamination level is more than the reference value and a second course execution step S40 executed when the measured contamination level is less than the reference value.

If the first measuring step S25 is provided as a step of measuring only the concentration of odor particles, any one of the first course execution step S30 and the second course execution step S40 may be executed as the treating step depending on whether the measured concentration of odor particles is the reference value or more.

In this case, the first course execution step S30 may include a step of operating the water supply module 5 for a first supply time which is preset, and the second course execution step S40 may include a step of operating the water supply module 5 for a second supply time which is preset. If the operation time of the water supply module 5 is long, since it is favorable to remove odor particles, the first supply time is preferably set to be longer than the second supply time.

If the first measuring step S25 is provided as a step of measuring only the concentration of dust, any one of the first course execution step S30 and the second course execution step S40 may be executed as the treating step depending on whether the measured concentration of dust is the reference value or more.

In this case, the first course execution step S30 may include a step of reciprocating the support module 6 at a first period which is preset, and the second course execution step S40 may include a step of reciprocating the support module 6 at a second period which is preset. If a reciprocating period of the support module 6 is short, since it may more shake the laundry (since dust of the laundry may be removed more effectively), the second period is preferably set to be long the first period.

Meanwhile, if the first measuring step S25 is provided as a step of measuring both the concentration of odor particles and the concentration of dust, the second course execution step S40 may be executed as the treating step if the measured concentration of odor particles and the concentration of dust are less than the reference value, and the first course execution step S30 may be executed as the treating step if at least one of the measured concentrations exceeds the reference value.

For example, if the concentration of odor particles is less than the odor reference value and the concentration of dust is less than the dust reference value, the second course execution step S30 may be executed as the treating step. However, if the concentration of odor particles is less than the odor reference value but the concentration of dust is more than the dust reference value, if the concentration of odor particles is more than the odor reference value but the concentration of dust is less than the dust reference value, or if the two concentrations are more than the reference values, the first course execution step S30 may be executed as the treating step.

The displaying step S50 may be initiated to be earlier than the treating steps S30 and S40, or may be initiated together with the treating steps S30 and S40. In the displaying step S50, the display module 271 may be provided to display different symbols, different texts or different images (icons, etc.) depending on the measured contamination level. Unlike this case, the display module 271 may display same symbols in different colors depending on the measured contamination level, display same texts in different colors depending on the contamination level or display same images in different colors depending on the contamination level.

After the displaying step S50 is completed, a step S51 of determining whether a preset reference time has passed from the time when the treating steps S30 and S40 are initiated is executed. The reference time is set to be shorter than the execution time determined in the execution time determining step S11. The reference time may be set to a time of 90% to 95% of the execution time. For example, if the execution time is set to 100 minutes, the reference time may be set to 90 minutes to 95 minutes.

If it is determined that the reference time does not pass from the time when the treating steps S30 and S40 are initiated (S51), the control method for the present disclosure determines whether a preset reference time has passed from the time when the treating steps S30 and S40 are initiated (S53). The reference period is preferably set to be shorter than the reference time, and may be set to a time corresponding to 10% to 20% of the execution time. That is, if the execution time is 100 minutes, the reference period may be set to 10 minutes to 20 minutes.

If the preset reference period has passed from the time when the treating steps S30 and S40 are initiated, the control method for the present disclosure executes a measuring step S55 (measuring step per period) of measuring a contamination level through the sensing module 7. If the measuring step S55 per period is completed, the control method of the present disclosure displays the contamination level measured in the measuring step S55 per period on the display module 271. In the control method for the present disclosure, since the measuring step S55 and the displaying step S50 are repeated per reference period while the treating steps S30 and S40 are being executed, how the contamination level of the laundry is changed may be notified to the user.

Unlike the aforementioned description, the step S53 of determining whether the reference period has passed may be provided to determine whether the reference period has passed from the time when the displaying step S50 is completed.

Meanwhile, if it is determined that the reference time has passed after the treating steps S30 and S40 are initiated, the control method for the present disclosure executes a measuring step S60 (second measuring step) of measuring a contamination level of the air through the sensing module 7.

If the contamination level measured in the second measuring step S60 is a preset target value or less (S61), the control method for the present disclosure determines whether the execution time has passed (S63). The step S63 of determining whether the execution time has passed is a step of allowing the controller to determine whether the execution time determined in the execution time determining step S11 has passed from the time when the treating steps S30 and S40 are initiated.

If it is determined that the execution time has passed (S63), the control method for the present disclosure executes a final contamination level displaying step S80 of displaying the contamination level measured in the second measuring step S60 on the display module 271 after ending a course which is being executed (S70). Through the final contamination level displaying step S80, the user may check how the contamination level of the laundry has been improved by the treating steps S30 and S40. The final contamination level displaying step S80 may include a step of displaying both the contamination level measured in the first measuring step S35 and the contamination level measured in the second measuring step S60 on the display module 271.

If the contamination level measured in the second measuring step S60 is greater than the target value (S61), the control method for the present disclosure executes an extension step S62 of extending the execution time determined in the execution time determining step S11. This is to reduce the contamination level of the laundry to reach a target level by increasing the execution time of the treating steps S30 and S40.

However, the extension step S62 is preferably executed only if the extension times of the execution time are reference times or less (S64). This is to prevent the execution time of the treating steps S30 and S40 from being too long. The reference times are preferably set to twice or three times.

Meanwhile, if the execution times of the extension step S62 are greater than the reference times, the control method for the present disclosure proceeds to an ending step S70 (step of ending execution of the treating step) of ending a current course after proceeding to a step S66 of displaying a message for recommending water washing on the display module 271. The step S66 of displaying the message is a step of notifying a user that a contamination level of laundry cannot be lowered by the treating steps S30 and S40 provided in the laundry treating apparatus 100 of the present disclosure any more. The present disclosure may propose the user to perform a separate action such as washing (laundry treating process of removing contaminant from laundry by using water) through the step S66 of displaying the message. The step S66 of displaying the message may be provided to be executed after the ending step S70 is completed.

If the course selected by the user is not the automatic course (S12), the control method for the present disclosure proceeds to the course execution step S13 of operating the air supply module 4, the water supply module 5 and the support module 6 in accordance with the course selected by the user.

While the course execution step S13 is being executed, the control method for the present disclosure proceeds to the measuring step S15 (measuring step per period) of measuring a contamination level of the air entering the intake duct 411 through the sensing module 7 and the displaying step S17 of displaying the measured contamination level on the display module 271.

After the displaying step S17 is completed, the control method for the present disclosure determines whether the execution time determined in the execution time determining step S11 has passed (S18). If the execution time of the course execution step S13 has passed the determined execution time, the control method for the present disclosure ends the current course (S70). However, if the execution time of the course execution step S13 has not passed the determined execution time, the control method for the present disclosure repeats the measuring step S15 and the displaying step S17 per reference period.

The aforementioned displaying steps S17 and S50 and the final contamination level displaying step S80 may be provided to display the contamination level on the display module 271 by dividing the contamination level into multiple levels. FIG. 4 illustrates that the contamination level is divided into three levels (bad, normal, good), as an example. In this case, the reference value may be set to a value for identifying a first level (bad level) from a second level (normal level), and the target value may be set to a value for identifying the second level (normal level) from a third level (good level).

Although not shown, the laundry treating apparatus 100 of the present disclosure may be provided to include a treating apparatus communication module provided in the second chamber 112, and a portable terminal receiving information transmitted from the communication module. The portable terminal may be provided to include a terminal communication module performing communication with the treating apparatus communication module, and a terminal display module on which information is displayed. In this case, the control method for the present disclosure may further include a step (terminal transmitting step) of transmitting the measured contamination level to the portable terminal when each of the measuring steps S25, S55 and S60 is completed.

The terminal transmitting step may be executed through the treating apparatus communication module and the terminal communication module, and when the terminal communication module receives the contamination level, the portable terminal may be provided to display the received contamination level on the terminal display module.

It will be apparent to those skilled in the art that the present specification can be embodied in other specific forms without departing from the spirit and essential characteristics of the specification. Thus, the above embodiments are to be considered in all respects as illustrative and not restrictive. The scope of the specification should be determined by reasonable interpretation of the appended claims and all change which comes within the equivalent scope of the specification are included in the scope of the specification.

What is claimed is:

1. A laundry treating apparatus comprising:

a cabinet;

a first chamber provided inside the cabinet, configured to accommodate laundry;

a support module provided in the first chamber, configured to hang the laundry;

a driving module configured to drive the support module to reciprocate along a width direction of the first chamber;

a circulating duct configured to draw out air inside the first chamber and then re-supply the air to the first chamber;

a first heat exchanger configured to dehumidify the air entering the circulating duct;

a second heat exchanger configured to heat the air passing through the first heat exchanger;

a fan provided inside the circulating duct;

a water supply module configured to supply water to the first chamber;

a sensing module configured to measure a contamination level by measuring at least one of a concentration of dust and a concentration of odor particles, which are contained in the air of the first chamber; and a display module configured to display the contamination level, wherein the sensing module measures the contamination level per preset reference period, and the display module displays the contamination level per reference period while treating the laundry is executed for an execution period, wherein the preset reference period is shorter than the execution period.

2. The laundry treating apparatus of claim 1, wherein the displaying module is provided to display at least one of (i) symbols set differently depending on the contamination level, (ii) texts set differently depending on the contamination level, (iii) images set differently depending on the contamination level, (iv) same symbols set in different colors depending on the contamination level, (v) same texts set in different colors depending on the contamination level, and (vi) same images set in different colors depending on the contamination level.

3. The laundry treating apparatus of claim 2, wherein the sensing module is disposed at the circulating duct, and wherein the driving module is configured to drive the support module to reciprocate and the fan is configured to circulate the air when the sensing module measures the contamination level.

4. The laundry treating apparatus of claim 1, wherein the driving module is configured to drive:

the support module to reciprocate at a first preset period based on the concentration of dust measured by the sensing module being greater than or equal to a reference value; and the support module to reciprocate at a second preset period that is longer than the first preset period based on the concentration of dust measured by the sensing module being less than the reference value.

5. The laundry treating apparatus of claim 1, wherein the water supply module is configured to:

be operated for a first supply time which is preset based on the concentration of odor particles being greater than or equal to a reference value; and be operated for a second supply time set to be shorter than the first supply time based on the concentration of odor particles being less than the reference value.

6. The laundry treating apparatus of claim 1, wherein the sensing module is configured to measure a subsequent contamination level based on an elapse of a reference time from a start time of treating the laundry, wherein the reference time is set to be shorter than the execution period and longer than the preset reference period, wherein the execution period is extended based on the subsequent contamination level being greater than a preset target value.

7. The laundry treating apparatus of claim 6, wherein the execution period is allowed to be extended based on a number of extensions of the execution period being less than a preset reference times.

8. The laundry treating apparatus of claim 7, wherein the laundry treating apparatus is configured to end the laundry treating, and the display module is configured to display a message recommending water washing based on the number of extensions of the execution period being greater than the preset reference times.

* * * * *